United States Patent [19]

Geiger

[11] Patent Number: 4,541,395

[45] Date of Patent: Sep. 17, 1985

[54] PRESSURE REGULATION IN PUMPING A LIQUID

[76] Inventor: Leroy Geiger, 301 Murray Ave., Appleton, Wis. 54915

[21] Appl. No.: 573,209

[22] Filed: Jan. 23, 1984

[51] Int. Cl.[4] ..... F02M 37/20

[52] U.S. Cl. ..... 123/514; 137/433

[58] Field of Search ..... 123/514, 510–513; 137/433

[56] References Cited

U.S. PATENT DOCUMENTS

| | | | |
|---|---|---|---|
| 1,134,457 | 4/1915 | Jay | 123/510 |
| 1,235,250 | 7/1917 | Seager | 123/510 |
| 1,368,475 | 2/1921 | Blakely | 123/514 |
| 1,410,013 | 3/1922 | Huntley | 123/510 |
| 1,492,147 | 4/1924 | Van Hise et al. | 123/510 |
| 1,639,784 | 8/1927 | Porsche | 123/510 |
| 4,168,687 | 9/1979 | Kurahashi et al. | 123/510 |

FOREIGN PATENT DOCUMENTS

| | | | |
|---|---|---|---|
| 2303167 | 10/1976 | France | 123/510 |
| 1575643 | 9/1980 | United Kingdom | 123/514 |

*Primary Examiner*—Magdalen Y. C. Moy

*Attorney, Agent, or Firm*—Thomas D. Wilhelm

[57] ABSTRACT

A pressure regulator for liquid pumping systems, and particularly fuel supply systems for use in vehicles, is disclosed. The regulator is designed with an inlet from the fuel pump, an outlet to the engine fuel inlet, and a drain outlet for draining fuel, in excess of that required by the engine, back to the fuel tank. During engine operation, fuel flow is continuous from the tank to the fuel pump, and from the fuel pump to the regulator. In most cases, fuel is continuously flowing from the regulator back to the fuel tank. Constant fuel flow through the regulator replenishes, in the regulator, the fuel drawn by the engine. A consistent fuel pressure is presented to the engine fuel inlet. The regulator and its systems are disclosed, as are methods of use of the regulator and the systems.

25 Claims, 13 Drawing Figures

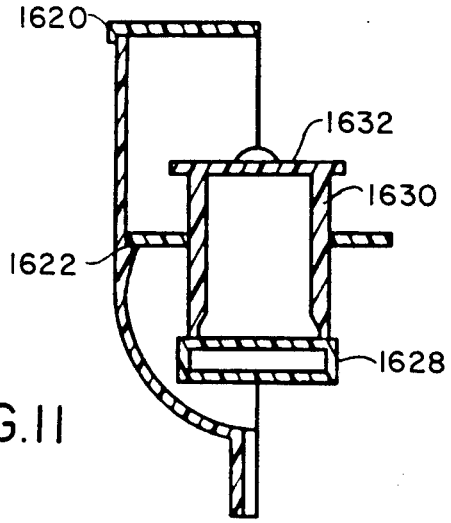
FIG.11
FIG.12
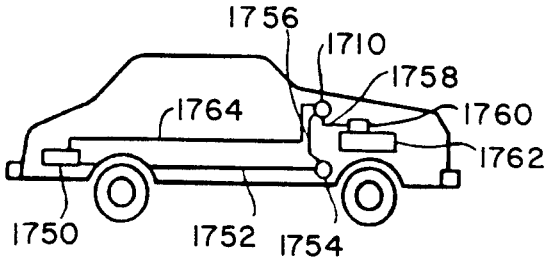
FIG.13
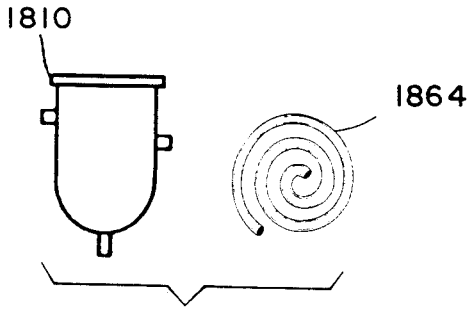

PRESSURE REGULATION IN PUMPING A LIQUID

BACKGROUND OF THE INVENTION

In the normal process of supplying of fuel to internal combustion engines, as in carbureted gasoline engines, fuel is supplied by a fuel pump directly to the carburetor float bowl. The flow of fuel into the float bowl is typically controlled by a needle valve in the fuel inlet line, the needle valve being connected to a float in the bowl.

The ease of drawing fuel from the float bowl into the chamber where it is mixed with air for subsequent feed to the cylinders is variably dependent on the level of fuel in the float bowl. The higher the fuel level, the more easily it is drawn into the mixing chamber for a given air flow, and thus the greater the quantity of fuel used. Ideally, of course, the quantity of fuel used should be the minimum amount which will support proper operation of the engine. Greater amounts are wasted. Lesser amounts cause poor performance.

The level of fuel in the float bowl depends, in combination, on the setting of the float and the pressure exerted on the needle valve by the fuel coming from the fuel pump. At any time, the fuel level in the float bowl may be changed by adjusting the float setting. Thus is there direct control of the float setting. In conventional fuel systems, however, the pressure exerted on the needle valve remains a variable. The source of the variability is in the fuel pump, in that, as the fuel pump wears with use, the outlet pressure from the pump to the needle valve gradually declines. Typical outlet pressure from a new fuel pump is in the range of 10 to 15 pounds per square inch (psi). As the pump wears, the pressure gradually drops until it reaches zero which is usually associated with pump failure. Since, in normal consumer operation, the fuel pump may go its entire useful life without inspection or evaluation, and likewise, the carburetor float may never be adjusted, the float level may be set for satisfactory operation of the engine at minimum fuel pressure output from the fuel pump, even when the engine is fairly new. This assures satisfactory engine power output at any fuel pump pressure. Given this setting of the float level, and the higher fuel pump outlet pressure of a newer pump, the fuel level in the float bowl is higher than necessary when the pump output pressure is in the higher portion of its overall lifetime range. Given the fact that the fuel level in the float bowl is higher than necessary during this period, the amount of fuel drawn into the chamber where it is mixed with air is also greater than necessary; and this extra fuel is, on the whole, wasted. As the fuel pump wears, of course, and the fuel pressure to the needle valve drops, the amount of fuel wasted in this way decreases, as the fuel level in the float bowl declines somewhat in response to the drop in fuel pressure at the needle valve. This normal change in the fuel pressure with wear on the fuel pump, in many cases, as described, results in a more economical utilization of fuel toward the latter stages of the useful life of the fuel pump. Earlier in the life of the fuel pump, fuel is typically wasted, as above.

It is thus an object of this invention to provide a means of supplying a constant fuel pressure at the needle valve inlet to a carburetor, on an engine, so that the fuel level in the float bowl will remain constant.

It is another object to provide a pressure regulator in the fuel line which will supply fuel to the carburetor at a constant pressure.

It is yet another object to provide a fuel supply system which can provide a constant pressure of fuel to the carburetor.

In another sense, it is an object to provide a method of supplying fuel to an engine at a constant pressure.

Indeed, it is yet another object to provide a kit which may be used to modify a fuel supply system such that the modified fuel supply system will supply fuel to the engine at a constant pressure.

SUMMARY OF THE INVENTION

These and other objects of the invention are attained by the use of a pressure regulator in a system wherein a liquid is continuously pumped toward an outlet, and wherein the fluid pressure at the outlet is desirous of being maintained at a low level which is near atmospheric pressure. The regulator comprises a containing receptacle having three holes therein and a partition dividing the container into an upper chamber and a lower chamber. The partition contains aperture means for gravity flow of liquid through it from the upper chamber to the lower chamber. At least one of the holes in the receptacle is in a horizontal plane above the partition; and at least one of the holes is in a horizontal plane below the partition.

Preferrably two of the holes in the receptacle are above the partition. In those embodiments where there are two holes above the partition, it is desirable that those two holes be spaced vertically such that the lower edge of the upper hole is in a horizontal plane above the upper edge of the lower hole.

The pressure regulator includes float means in the lower chamber, the float means being so configured and positioned as to cause an impediment to passage of liquid through the aperture means when there is liquid in the lower chamber. The float means is most easily and simply connected to the partition. The most facile connection is by a rod slidable in a central opening through the partition. In one family of these configurations, when the float is raised by liquid in the lower chamber, the rod slides upwardly through the partition, and the float means comes proximate, and in face-to-face relationship, with the aperture means, thereby impeding liquid flow through the aperture means. In such case, the aperture means may be as a plurality of holes above the float, or may comprise a plurality of channels extending outwardly from the central opening in the partition in which the rod slides.

In another family of these configurations, the rod has channels in it extending along its length. The channels have a length greater than the thickness of the partition at the point where the rod slides through the partition. In this family of configurations, the aperture means preferrably comprises one passage through the partition. Also preferrably, the passage is at an angle essentially perpendicular to the partition. Desirably, the size and shape of each the rod and the aperture means conform closely in size and shape to each other.

The invention is further exemplified by a system for supplying fuel to an engine from a fuel tank which is in a horizontal plane below the fuel intake of the engine, the engine having means for mixing, with air, fuel which is held at or near atmospheric pressure. Fuel is drawn from the fuel tank to a fuel pump which pumps it to a pressure regulator. The pressure regulator provides fuel to the engine fuel inlet at a constant pressure by gravity induced flow. Excess fuel is drained from the pressure regulator to the fuel tank. The regulator is positioned in a horizontal plane vertically higher than the tank and the mixing means. A pressurized fuel line connects the fuel pump to the regulator. Unpressurized fuel lines connect the tank to the fuel pump, the regulator to the engine fuel inlet, and the regulator to the fuel tank. The pressure regulator is functional in reducing the pressure in the fuel received from the fuel pump to approximately atmospheric pressure. The fuel is then delivered by gravity flow to the engine. Excess fuel delivered to the regulator is returned to the fuel tank through the fuel line connecting the regulator to the fuel tank.

In another sense, the invention is exemplified in a method of supplying fuel from a tank to an engine wherein the tank outlet is in a horizontal plane below the fuel intake of the engine. In this method, fuel is drawn from the tank to a fuel pump. The fuel pump pumps the fuel under a pressure to a pressure regulator which is effective to reduce the pressure to approximately atmospheric pressure. From the pressure regulator, fuel is supplied to the engine by gravity flow. Excess fuel received from the fuel pump which is more than that required by the engine operation is returned to the tank through fuel lines connecting the regulator and the fuel tank. The regulator is, of course, positioned in a horizontal plane above the engine fuel inlet and the fuel tank, so that gravity flow will be affective to conduct fuel to the engine fuel inlet, and to the tank as desired.

Further, the invention includes a kit for modifying the fuel supply system of an engine wherein the system includes a fuel tank, a fuel pump and a fuel inlet to the engine. The kit includes a fuel pressure regulator described herein above and tubing of sufficient diameter and length to carry excess fuel from the pressure regulator to the tank.

In a broader sense, the invention is in a system for supplying liquid from a tank to an outlet which is in a horizontal plane above the tank. The system includes a pump connected to the tank and capable of drawing liquid from the tank. A pressure regulator is positioned in a horizontal plane above the tank and has liquid communication means with the outlet and the pump. There is also means for returning excess liquid from the pressure regulator to the tank by gravity flow. Means is provided for gravity flow of the liquid from the regulator to the outlet.

The invention also embraces a method of providing a constant liquid pressure to an outlet where the liquid is drawn from a tank in a horizontal plane below the outlet, the method comprising drawing liquid from the tank to a liquid pump, pumping the liquid to a pressure regulator where the pressure regulator has means for reducing the pressure to approximately atmospheric pressure, and supplying the liquid to the outlet by gravity flow from the regulator. Liquid pumped to the regulator which is in excess of that drawn off at the outlet is returned to the tank by gravity flow.

BRIEF DESCRIPTION OF THE DRAWINGS

FIG. 11 is a vertical section taken at 11—11 of FIG. 9 and showing especially the internal features of the float-valve subcombination.

FIG. 12 shows the outline of a motor vehicle, and points out the locations of the various elements of the invention in their typical locations in the vehicle.

FIG. 13 shows the component parts of a kit for modifying an engine according to the invention.

DETAILED DESCRIPTION OF THE ILLUSTRATED EMBODIMENTS

A pressure regulator is used for liquid pumping systems, and particularly for fuel supply systems for use in vehicles. The regulator is designed with an inlet from the fuel pump, an outlet to the engine fuel inlet, and a drain outlet for draining fuel in excess of that required by the engine, back to the fuel tank. During engine operation, fuel flow is continuous from the tank to the fuel pump, and from the fuel pump to the regulator. In most cases, fuel is continuously flowing from the regulator back to the fuel tank. Constant fuel flow through the regulator replenishes, in the regulator, the fuel drawn by the engine. A constant fuel pressure is presented to the engine fuel inlet, that pressure being controlled by the constant force of gravity. The regulator and its system are disclosed; as are methods of use of the regulator and the system, to provide a constant pressure at the engine fuel inlet, and uniform fuel flow commensurate with the constant pressure.

Figure 1:
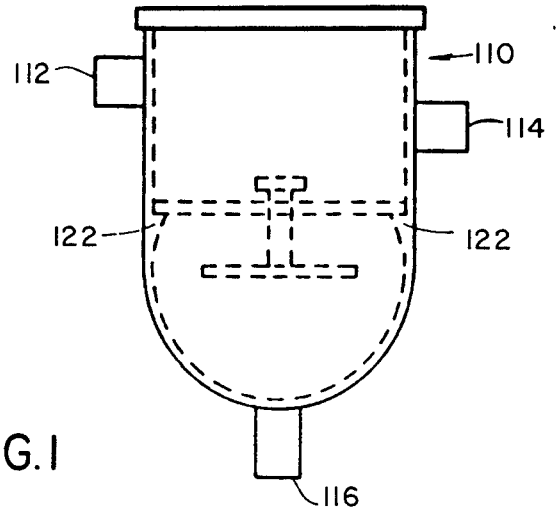
FIG. 1 shows an external view of a pressure regulator of this invention. Surfaces on the interior of the regulator are shown in phantom outline.

The general nature of the invention is shown in FIG. 1 as a pressure regulator 110. In combination, the regulator includes a plurality of parts which are shown in phantom outline in FIG. 1, but are best seen in others of the drawings. It is instructive to note that there are three holes 112, 114, and 116 in the regulator, which are also better seen in others of the FIGURES.

Figure 2:
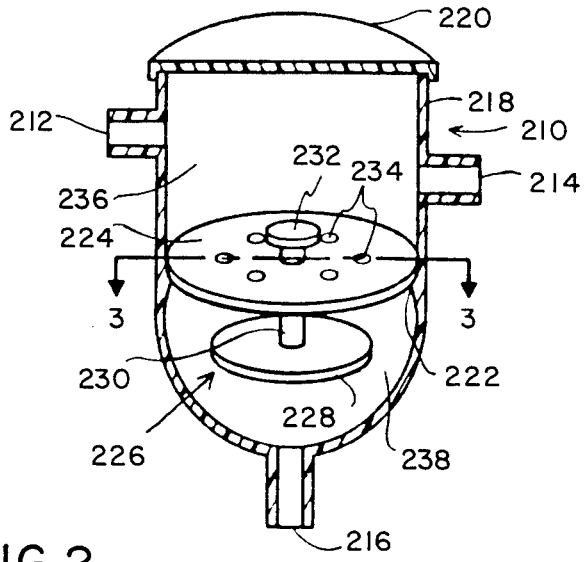
FIG. 2 shows a preferred embodiment of the pressure regulator of this invention, with half of the container cut away to show the interior of the regulator.

Continuing, now, with the description, FIG. 2 shows a regulator 210 as in FIG. 1, with a section of the container 218 only having been cut away by a vertical cutting plane, exposing the internal features of the regulator. FIGS. 5, 7, 12, and 14 are views using similar cut away sections to expose the internal features of those embodiments of the regulator.

The last two digits of each element of the invention are common throughout all the teachings herein for each element. Thus all partitions end in "24", such as 224, 424, etc., with the preceding digits representing the FIGURE numbers of the drawings.

Returning to FIG. 2, the regulator desirably has a closure cap 220. The container 218 has three holes at 212, 214, and 216. The holes are shown molded with flanges for ease of connecting tubing thereto. More or less midway of the vertical sidewall of the container is a ledge 222 which projects inwardly of the container wall. The ledge is best seen in a side view such as at 122 of FIG. 1 or 1622 of FIG. 11. Throughout the description of the invention herein, the ledge is portrayed as being continuous about the interior circumference of the container. As will be evident upon completion of the disclosure herein of the invention, the ledge may take on a number of alternate configurations, such as disconinuities, without departing from its purpose. Indeed, the ledge is not critical to the invention, but rather, provides an easy and economical assistance in assembly of the regulator.

Again referring to FIG. 2, positioned on the ledge 222 is partition 224. Projecting through partition 224 is float subassembly 226. The float subassembly 226 includes a float 228 and a rod 230. The rod has a head 232 which may or may not be integral with rod 230. The partition 224 has apertures 234 above float 228 and has a central opening through which rod 230 slides in the partition.

When the regulator is empty, the float subassembly drops downwardly. Head 232 abutts the top of partition 224.

Liquid fuel enters the upper chamber 236 of the regulator from the fuel pump, preferrably through inlet hole 212. It flows by gravity through apertures 234 into the lower chamber 238. When liquid fuel enters the lower chamber 238 and rises to the level of float 228, float 228 floats on the fuel. As the fuel rises further, the float rises with it, raising the entire float subassembly 226. As the fuel level in the lower chamber approaches partition 224, so also does the top surface of float 228, which is floating on the fuel surface, approach the lower surface of partition 224. Lifting forces on the float 228 actively push it upwardly against the surface of partition 224. The upper surface of float 228 is so sized that, as it comes in proximate relationship with partition 224, it covers apertures 234, thus impeding flow of fuel through apertures 234 downwardly into lower chamber 238. As fuel continues to enter the regulator from the constantly pumping fuel pump faster than it is used by the engine, the fuel level rises in the upper chamber to the level of drain hole 214. When the fuel level reaches hole 214 it drains out that hole and is returned by connecting tubing to the fuel tank. Connecting tubing delivers fuel from the regulator outlet hole 216 to the fuel inlet of the engine, which is usually at the float bowl of a carburetor. As fuel is drawn through outlet 216, the fuel level in the lower chamber 238 drops slightly. As the fuel level drops, the float also drops slightly, providing an increase in the flow of fuel from the upper chamber into the lower chamber. As the amount of fuel in the lower chamber is replenished, the fuel level rises, as does the float. The rising of the float again brings the top of the float proximate the holes the fuel is flowing through, again impeding fuel flow. In actual practice, the float automatically stabilizes itself near the partition, just far enough away to permit the flow of the amount of fuel being drawn by the engine. As engine draw increases, the fuel level in the lower chamber drops slightly. The float also drops slightly, providing for increased fuel flow through apertures 234. The float 228 then stablizes at a new slightly lower level to accomodate the increased fuel drawn by the engine. Meanwhile, drain hole 214 continues to drain excess fuel back into the fuel tank via the connecting tubing. As engine draw decreases, the fuel level in the lower chamber rises slightly. The float also rises slightly, further restricting flow of fuel through apertures 234. The float 228 then stablizes at a new, slightly higher, level to accomodate the decreased fuel drawn by the engine.

Figure 3:
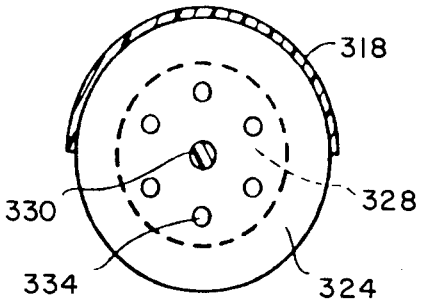
FIG. 3 is a section of the regulator of FIG. 2 taken at 3—3 of FIG. 2.

FIG. 3 shows a downward looking view of the cut-away regulator of FIG. 2. It particularly illustrates the superposition of the float 328, shown in phantom outline, over the apertures 334 when the float rises to the top of the lower chamber. It also specifically shows rod 330 in section and in relation to partition 324 through which it slides. A section of the receptacle 318 is, of course, cut-away as a reflection of the cut-away section in parent FIG. 2.

Figure 4:
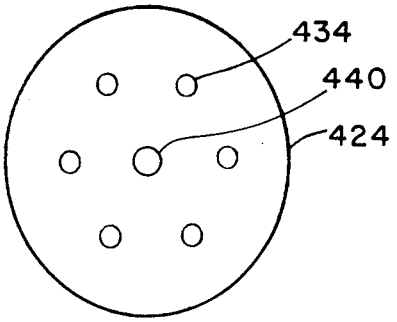
FIG. 4 is a top view of a partition such as is used in the FIG. 2 assembly.

FIG. 4 is a representative partition suitable for use in the regulator of this invention. As used in FIGS. 2 and 3, the partition of FIG. 4 includes a central opening 440, through which the rod is slidable.

The hydraulic pressure exerted at the engine intake, then, is the static hydraulic head resulting from gravity forces, and represented by the fuel in the regulator and in the line from the regulator to the engine.

Figure 5:
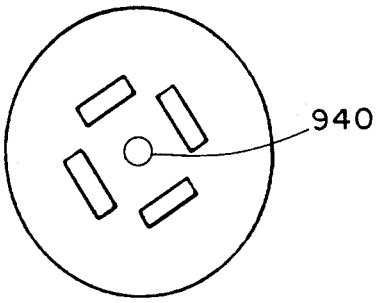
FIGS. 5, 6, and 8 show top views of additional embodiments of the partition useful in the regulators of this invention.

FIG. 5 shows a partition having exemplary and alternate aperture arrangements.

Figure 6:
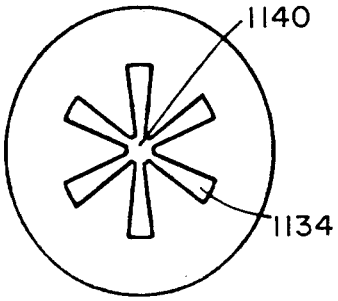

FIG. 6 shows apertures extending radially from the hole through which rod 30 slides.

It should be appreciated that float mechanisms other than the designs shown are adaptable to the invention, and are contemplated. Indeed, in an embodiment not shown the float function may be separated from the valving function by adding a flange to the rod intermediate the float and the lower surface of partition '24.

Figure 7:
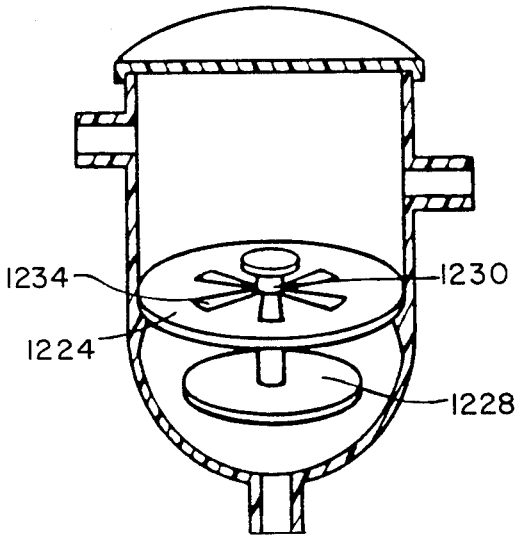
FIG. 7 shows yet another embodiment of the pressure regulator of this invention, with a section of the container cut away to show the interior of the regulator. The partition is that illustrated in FIG. 6.

The partition of FIG. 6 has apertures extending radially from the hole through which rod 1230 slides as shown in FIG. 7. As seen in this embodiment, the float 1228 covers apertures 1234 when it rises to the partition 1224.

Figure 8:
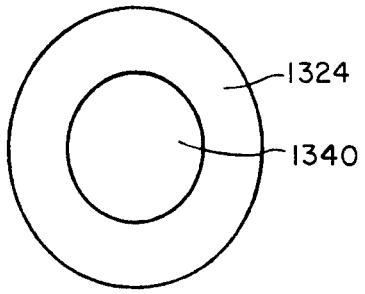
Figure 9:
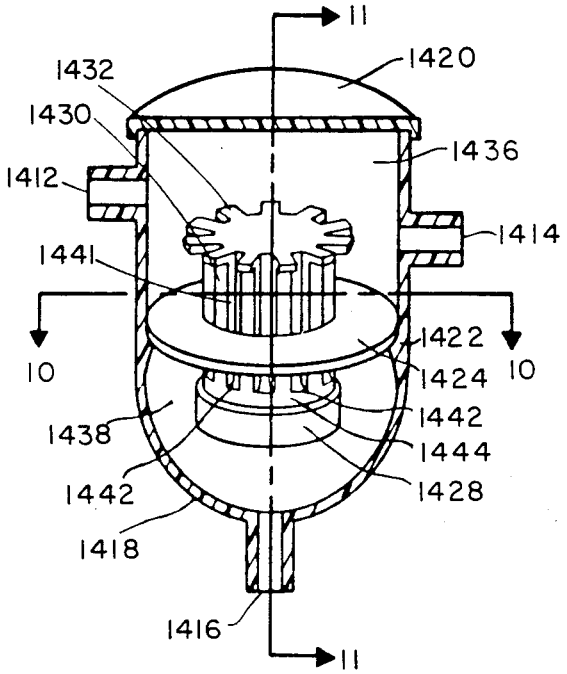
FIG. 9 shows still another embodiment of the pressure regulator of this invention with a section of the container cut away to show the interior of the regulator. The partition is that illustrated in FIG. 8.

FIGS. 8–11 illustrate another embodiment of the invention in which the rod and partition cooperate to control fuel flow independent of any particular superposition of the float on the partition. FIG. 8 shows a partition 1324 having one central opening 1340. The regulator assembly is seen in FIG. 9. Partition 1424 is located on ledge 1422 as previously. Rod 1430 has been modified on its exterior surface to include channels 1441 extending from the top of the rod downwardly toward its lower end. The channels 1441 terminate at 1442, short of the lower end of the rod, so that there is a length 1444 of rod near its lower end which is free of the channels. Included in the lower end of the rod 1430 is an element 1428 which may desirably be a float element; as is shown hollow at 1628 in FIG. 11. Its primary function is to provide a larger diameter, or other projection to prevent the rod subassembly from rising out of the central opening as the rod subassembly rises on the liquid fuel. Element 1428 may be hollow as shown to provide lifting/floating force. The main portion of rod 1430 may likewise be hollow as at 1530 and 1630 of FIGS. 10 and 11. Depending on the floating and lifting properties required, then, the lower element '28 may or may not function as a float. Indeed it may be a simple flange that impedes passage of the lower end of the rod upward through the central opening. Likewise, it need not be at the lower end of the rod, so long as it is sufficiently below the ends of the channels to allow the channels to function properly as elements restrictive to the flow of fuel.

In embodiments where the floating properties of rod '30 are sufficient for the proper floating function of the rod, element 1628 may be deleted provided that the length of rod '30 is extended (not shown) such that, as it floats on the fuel and rises, the head '32 impinges the cap '20 before the rod '30 rises out of the central opening.

Figure 10:
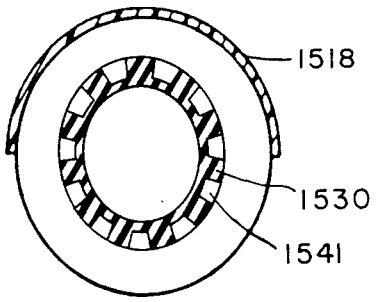
FIG. 10 is a section showing the partition and the float valve subcombination, taken at 10—10 of FIG. 9.

The initial operation of the regulator illustrated in FIGS. 9–11 begins with the rod having dropped down on the partition such that head 1432 rests on the partition 1424. Fuel enters at inlet 1412 and travels via channels 1441 from the upper chamber 1436 to the lower chamber 1438 and out outlet 1416 to the engine. As fuel in excess of that drawn by the engine is pumped into the regulator from the fuel pump, it accumulates in the lower chamber 1438. As the fuel level rises, the rod-float subassembly begins to float on the fuel, and rises with the fuel level. As the rod-float subassembly rises, the ends 1442 of channels 1441 approach the lower edge of partition 1424. As the ends 1442 of the channels 1441 approach the partition 1424, they restrict the flow of fuel through the channels. As in the embodiments earlier illustrated, the float-rod subassembly automatically sets itself at the proper setting to allow passage into the lower chamber of the amount of fuel drawn by the engine. Excess fuel, as before, is drained off at drain '14.

In the embodiment shown in FIG. 9, channels 1441 extend through head 1432 as shown. This illustrated design provides for fuel flow into the lower chamber 1438 when the rod is in its lower-most position with the head 1432 on the upper surface of partition 1424. Without the extension of the channels through the head, fuel would be obstructed from flowing by the head, if it were designed as an unbroken circle as in 232 of FIG. 2. An unbroken circle, however, may be used in combination with a rod sufficiently long enough to reach the bottom of the container without the head '32 reaching the partition '24. Thus the channels 1441 provide the means for flow of the fuel when the rod is in that position. Various design modifications may be made to the rod to accomplish the same results; namely, channel means may be provided for flow of fuel into the lower chamber, without excessive accumulation of fuel in the upper chamber while the rod is in its lower-most position.

The regulator of this invention is conveniently used in a motor vehicle in an arrangement outlined in FIG. 12. Fuel is drawn from tank 1750 through fuel line 1752 to the fuel pump 1754. The fuel is pumped through line 1756 to the regulator 1710 where it enters the regulator at inlet '12 (see FIG. 2 for '12, '14, and '16). Regulator 1710 is mounted in the vehicle in an imaginary horizontal plane vertically above the engine fuel inlet and the fuel tank. Similarly, the fuel tank is below the engine fuel inlet. From the regulator, fuel flows by gravity from outlet '16 through line 1758 to the engine fuel inlet 1760 which includes means for mixing the fuel and air and normally is a carburetor, and thence into the engine 1762 and its combustion chambers. Excess fuel is drained by gravity out of the regulator at drain '14 through line 1764 to the fuel tank 1750.

Vehicles are commonly manufactured with a fuel tank, a fuel pump, a carburetor, and lines connecting the tank to the pump and the pump to the carburetor. Thus the fuel supply system may be modified in accordance with this invention by inserting the regulator in the fuel line between the fuel pump and the carburetor, and by connecting a drain line from the regulator to the fuel tank. Since carburetor floats are commonly adjusted for acceptable function at minimal fuel inlet pressures, the regulators of this invention normally may be installed without any adjustment to the carburetor itself. The regulator, as stated earlier, is mounted above the carburetor inlet so that fuel will flow to the carburetor by gravity. Thus the essential elements of a kit for modifying an engine according to this invention are a regulator 1810 and length of fuel line 1864 as shown in FIG. 13. Mounting hardware and clamps may also be used, and conventional ones of these may be selected for any particular engine design.

The regulator and fuel line used in this invention may be made of any material which is compatible with direct contact with the fuel. As exemplary materials, both the fuel line and the regulator may be made of metal. Certain plastics may also be acceptable, such as polyethylene.

The fuel line will be manufactured by known means. The regulator may be fabricated from metal by known means. It may also be fabricated from plastic. As an example and using the embodiments of FIG. 2, the container 218, the cap 220, the partition 224, the float 228 and the combination of rod 230 and head 232 are all injection molded. In assembly, the rod is inserted through the central opening in partition 224 and float 228 is glued or otherwise attached to the end of rod 230. The partition-rod subassembly is then positioned on the ledge 222 which is around the periphery of the container 218. The partition is preferrably attached to the ledge as by adhesive, to fix it in place. The cap 220 is then fixed in place as by adhesion, completing the assembly.

The cup shape shown for the container is exemplary only, as it is anticipated that the cup shape may be more easily fabricated than another shape. Other shapes, though, could function equally well, with appropriate obvious modification to others of the elements to retain the same cooperative relationships herein described.

The location and spacing of the three holes, '12, '14, and '16, in the regulator, may be chosen within certain limitations. The outlet hole '16 should be located at or near the bottom of the regulator for good fuel flow. At least the inlet hole '12 must be above the partition in order for the upper chamber to have any significance. The drain hole '14 must be above outlet '16. It may be below partition '24, in which case the partition serves to dissipate the dynamic hydraulic head. Normally, however, the drain '14 is above the partition and is preferrably spaced vertically below inlet 12. In typical operation, the fuel level is maintained at the level of the drain '14. If the drain '14 is higher than inlet '12 or even at the same level, then the incoming fuel enters the regulator and tends to distribute its dynamic head, including any turbulence, to the fuel already in the regulator. While absolute dissipation of the dynamic head is not essential to the basic operation of the regulator, its operation in providing a constant fluid pressure to the carburetor is improved where dynamic hydraulic forces are minimized. Thus the fuel should flow into the regulator at an elevation above the fuel level. In any event the hydraulic pressure in the fuel received from the pump is reduced to near atmospheric pressure in the regulator, such that flow from the regulator is essentially governed by gravity. This gravity flow, then, presents a constant fluid pressure at the carburetor inlet, consistent with the constant and uniform force of gravity.

The float has been shown as being connected to the partition by a rod slidably mounted therethru. Other means of mounting the float may be used without detracting from the function of the invention.

The invention has been described herein in terms of a pressure regulator used in the fuel supply system of a motor vehicle. Similarly, the regulator has use in the pumping of any liquid to an outlet which is above the tank or other source from which the liquid is drawn. The outlet must be below the regulator. By way of clarification, the outlet may coincide with the outlet, as at 216, of the regulator. The tank is usually below the outlet. The methods of pumping the liquid and regulating its pressure use the same principles as those used in supplying fuels.

Having thus described the invention, what is claimed is:

1. A pressure regulator for use in a system wherein a liquid is continuously pumped toward an outlet, and wherein fluid pressure at said outlet is desirous of being maintained at a low level, which is near atmospheric pressure, said regulator comprising a container having three holes therein and a partition dividing said container into an upper chamber and a lower chamber; said partition having aperture means for passage of liquid therethrough from said upper chamber to said lower chamber; at least one of said holes being in a horizontal plane above said partition, and at least one of said holes being in a horizontal plane below said partition; and float means in said lower chamber.

2. A pressure regulator as in claim 1, said float means being so configured and positioned as to cause an impediment to passage of liquid through said aperture means in response to liquid in said lower chamber.

3. A pressure regulator as in claim 2 and wherein said float means is connected to said partition.

4. A pressure regulator as in claim 2 and wherein said partition is rigid and wherein said float means is connected to said partition by a rod slidable through said partition, whereby, when said float means is raised by liquid in said lower chamber, said rod slides upwardly through said partition and said float means comes proximate said aperture means, in face to face relationship therewith and covering said aperture means, thereby impeding liquid flow through said aperture means.

5. A pressure regulator as in claim 1, said partition being rigid, said float means being connected to said partition by a rod slidable through said partition, said rod having channels therein extending along the length thereof, said channels having a length greater than the thickness of said partition at the point where said rod slides through said partition.

6. A pressure regulator as in claim 5 and wherein two of said holes are in a horizontal plane above said partition and wherein said two holes are spaced vertically.

7. A pressure regulator as in claim 6 and wherein the size and shape of said aperture means closely conforms to the size and shape of said rod.

8. A system for supplying fuel to an engine, comprising:

(a) a fuel pump;
(b) an inlet for reception of fuel into said engine;
(c) a fuel tank in a horizontal plane below said fuel inlet of said engine;
(d) a fuel pressure regulator; and
(e) fuel lines connecting said tank to said fuel pump, said fuel pump to said regulator, said regulator to said tank, and said regulator to said engine inlet, said regulator being positioned in a horizontal plane vertically higher than said tank and said engine fuel inlet;

said pressure regulator comprising a container having three holes therein and a partition dividing said container into an upper chamber and a lower chamber; said partition having aperture means for passage of liquid therethrough, from said upper chamber to said lower chamber; at least one of said holes being in a horizontal plane above said partition, and at least one of said holes being in a horizontal plane below said partition; and float means in said lower chamber.

9. A fuel supply system as in claim 8, said float means being so configured and positioned as to cause an impediment to passage of liquid through said aperture means when there is liquid in said lower chamber.

10. A fuel supply system as in claim 9 and wherein said float means is connected to said partition.

11. A fuel supply system as in claim 10 and wherein said partition is rigid and wherein said float means is connected to said partition by a rod slidable through said partition whereby, when said float means is raised by liquid in said lower chamber, said rod slides upwardly through said partition and said float means comes proximate said aperture means, in face to face relationship therewith and covering said aperture means, thereby impeding liquid flow through said aperture means.

12. A fuel supply system as in claim 8 wherein said partition is rigid, and wherein said float means is connected to said partition by a rod slidable through said partition, said rod having channels therein extending along the length thereof, said channels having a length greater than the thickness of said partition at the location in said partition where said rod slides through said partition.

13. A fuel supply system as in claim 8 and wherein said partition in said regulator is rigid and wherein said float means is connected to said partition by a rod slidable through said partition and wherein said aperture means comprises one passage through said partition, said passage extending through said partition at an angle essentially perpendicular to said partition.

14. A fuel supply system as in claim 13 and wherein the size and shape of said aperture means in said regulator closely conforms to the size and shape of said rod.

15. A method of supplying liquid fuel from a tank to an engine having a fuel inlet, and wherein said tank is in a horizontal plane below the fuel inlet of said engine, the method comprising the steps of:

(a) drawing fuel from said tank to a fuel pump;
(b) pumping said fuel under pressure to a pressure regulator;
(c) supplying fuel to said engine by gravity flow from said regulator; and
(d) returning fuel, pumped in excess of the requirements of said engine, to said tank by gravity flow from said regulator through a fuel line;

said pressure regulator comprising a container having three holes therein and a partition dividing said container into an upper chamber and a lower chamber, said partition having aperture means for passage of fuel therethrough from said upper chamber to said lower chamber; at least one of said holes being above said partition; and float means in said lower chamber.

16. A method as in claim 15, said float means being so configured and positioned as to cause an impediment to passage of liquid through said aperture means in response to liquid in said lower chamber.

17. A method as in claim 15 and wherein , in said regulator, said partition is rigid and wherein said float means is connected to said partition by a rod slidable through said partition whereby, when said float means is raised by liquid in said lower chamber, said rod slides upwardly through said partition and said float means comes proximate said aperture means, in face-to-face relationship therewith and covering said aperture means, thereby impeding liquid flow through said aperture means.

18. A method as in claim 15, said partition being rigid, said float means being connected to said partition by a rod slidable through said partition, said rod having channels therein extending along the length thereof, said channels having a length greater than the thickness of said partition at the location in said partition where said rod slides through said partition.

19. A method as in claim 16 and wherein, in said regulator, said partition is rigid and wherein said float means is connected to said partition by a rod slidable through said partition and wherein said aperture means comprises one passage through said partition, said passage extending through said partition at an angle essentially perpendicular to said partition.

20. A method as in claim 19 and wherein the size and shape of said aperture means closely conforms to the size and shape of said rod.

21. A method of providing a constant liquid pressure to an outlet wherein a liquid tank is positioned in a horizontal plane below said outlet, the method comprising the steps of:

(a) drawing liquid from said tank to a liquid pump;

(b) pumping said liquid under a pressure to a pressure regulator positioned in a horizontal plane above said inlet, said pressure regulator comprising an upper chamber, a lower chamber, and a partition therebetween, and float means in said lower chamber; said regulator having means for reducing said pressure to approximately atmospheric pressure;

(c) supplying liquid to said inlet by gravity flow from said regulator; and (d) returning excess liquid to said tank by gravity flow from said regulator.

22. A kit for modifying an engine having a fuel supply system, and wherein said fuel supply system includes a fuel tank, a fuel pump, and a fuel inlet to the engine, said kit comprising:

(a) a fuel pressure regulator, and (b) tubing of sufficient diameter and length to carry excess fuel from said pressure regulator to said tank;

said pressure regulator including a container having three holes therein and a partition dividing said container into an upper chamber and a lower chamber, said partition having aperture means for passage of liquid therethrough from said upper chamber to said lower chamber; at least one of said holes being in a horizontal plane above said partition, and at least one of said holes being in a horizontal plane below said partition; said pressure regulator further including float means in said lower chamber.

23. A kit as in claim 22, said float means being so configured and positioned as to cause an impediment to passage of liquid through said aperture means in response to liquid in said lower chamber.

24. A kit as in claim 23 and wherein said partition is rigid and wherein said float means is connected to said partition by a rod slidable through said partition whereby, when said float means is raised by liquid in said lower chamber, said rod slides upwardly through said partition and said float means comes proximate said aperture means, in face to face relationship therewith and covering said aperture means, thereby impeding liquid flow through said aperture means.

25. A system for supplying liquid from a tank to an outlet in a horizontal plane above said tank, said system comprising:

(a) a pump connected to said tank and capable of drawing liquid from said tank;

(b) a pressure regulator in a horizontal plane above said tank and having liquid communication means with said outlet and said pump, said pressure regulator including a container having three holes therein and a partition dividing said container into an upper chamber and a lower chamber, said partition containing aperture means for passage of liquid therethrough from said upper chamber to said lower chamber, at least one of said holes being in a horizontal plane above said partition and at least one of said holes being in a horizontal plane below said partition, said pressure regulator further including float means in said lower chamber;

(c) means for returning excess liquid from said pressure regulator to said tank by gravity flow of said liquid; and (d) means for gravity flow of said liquid from said regulator to said outlet.

* * * * *